US011116313B2

(12) United States Patent
Leung

(10) Patent No.: US 11,116,313 B2
(45) Date of Patent: Sep. 14, 2021

(54) FOLDABLE STORAGE RACK

(71) Applicant: Vigor Household Goods Co., Ltd, Guangdong (CN)

(72) Inventor: David Leung, Guangdong (CN)

(73) Assignee: Vigor Household Goods Co., Ltd, Zhongshan (CN)

( * ) Notice: Subject to any disclaimer, the term of this patent is extended or adjusted under 35 U.S.C. 154(b) by 0 days.

(21) Appl. No.: 16/747,378

(22) Filed: Jan. 20, 2020

(65) Prior Publication Data

US 2021/0161290 A1 Jun. 3, 2021

(30) Foreign Application Priority Data

Dec. 3, 2019 (CN) ..... 201911218016.9

(51) Int. Cl.
*A47B 43/00* (2006.01)
*A47F 5/10* (2006.01)

(52) U.S. Cl.
CPC ..... *A47B 43/00* (2013.01); *A47F 5/10* (2013.01)

(58) Field of Classification Search
CPC ..... A47B 31/04; A47B 43/00; A47B 45/00; A47F 5/10; A47F 5/13
USPC ..... 108/59, 115, 170–173, 175, 188, 186, 108/180, 181, 185; 211/149, 150, 153
See application file for complete search history.

(56) References Cited

U.S. PATENT DOCUMENTS 1,198,431 A * 9/1916 Forsyth ..... A47F 5/13 108/163
2,938,632 A * 5/1960 Mondineu ..... A47B 31/04 108/106
3,093,247 A * 6/1963 Erickson ..... A47B 31/04 108/188
3,484,810 A * 12/1969 Boss ..... A47B 45/00 108/152
3,766,863 A * 10/1973 Swick, Jr. ..... A47B 47/021 108/188
5,131,547 A * 7/1992 Goldberg ..... A47F 5/13 108/166
9,226,574 B1 * 1/2016 Chen ..... A47B 96/021
9,615,654 B2 * 4/2017 Grace ..... A47B 3/087
10,292,491 B1 * 5/2019 Ke ..... A47F 5/137
2004/0238469 A1 * 12/2004 Ng ..... A47B 43/00 211/149
2010/0326938 A1 * 12/2010 Zhu ..... A47F 5/10 211/149
2016/0066687 A1 * 3/2016 Frankel ..... A47B 55/02 211/149
2020/0405050 A1 * 12/2020 Liu ..... A47B 43/00

* cited by examiner

*Primary Examiner* — Janet M Wilkens
(74) *Attorney, Agent, or Firm* — Weitzman Law Offices, LLC

(57) ABSTRACT

A foldable storage rack, including side frames, connecting arms and shelves. When unfolded, the foldable storage rack can satisfy a user's storage needs, and when the foldable storage rack is being transported or idle, the side frames, the connecting arms and the shelves of the foldable storage rack are folded in an interlinked manner. The foldable storage rack in a folded state occupies a small space and is convenient for storage and transportation.

7 Claims, 8 Drawing Sheets

FOLDABLE STORAGE RACK

CROSS REFERENCE TO RELATED APPLICATION

This application claims priority to Chinese Pat. App. No. 201911218016.9, filed on Dec. 3, 2019, which is hereby incorporated by reference in its entirety.

TECHNICAL FIELD

The present invention relates to the technical field of household articles, and in particular to a foldable storage rack.

BACKGROUND

A conventional storage rack generally comprises two side frames and a plurality of laminates that are horizontally connected to the side frames at intervals. However, such a conventional storage rack is mainly manufactured in a non-detachably welding manner or in an assembled/disassembled manner. For manufacturers, the welding procedure is complicated, and large space for transportation is required, thus the cost is increased. For users, in terms of the disassembly/assembly mode, it is not easy to mount this storage rack, or even the storage rack cannot be mounted due to the risk of components missing.

SUMMARY

The invention is aimed at solving at least one of the technical problems in the prior art.

For this purpose, the present invention provides a foldable storage rack.

In accordance with an embodiment of a first aspect of the present invention, the foldable storage rack comprises side frames, connecting arms and shelves. The side frames comprise a first side frame, a second side frame, and guide grooves in an elongated shape extending in a vertical direction and respectively arranged on rear side faces of the first side frame and the second side frame. The connecting arms is arranged in the rear of the foldable storage rack, and comprises a first connecting arm, a second connecting arm, and slide shafts, wherein: one end of each of the first connecting arm and the second connecting arm is hinged to one of the slide shafts, the first connecting arm is intersected and connected with the second connecting arm, the slide shafts are embedded into and slide along the guide grooves, such that, when the slide shafts slide to ends of the guide grooves, the foldable storage rack is in an unfolded or folded state; the other end of the first connecting arm is hinged to the second side frame, and the other end of the second connecting arm is hinged to the first side frame, such that, when the foldable storage rack is in the unfolded state, the first side frame and the second side frame are respectively located on left and right sides of the foldable storage rack, and, when the foldable storage rack is in the folded state, the first side frame and the second side frame are close to each other. The shelves comprises a left shelf and a right shelf, wherein one end of the left shelf is hinged to one end of the right shelf, the other end of the left shelf is hinged to the first side frame, and the other end of the right shelf is hinged to the second side frame, such that, when the foldable storage rack is in the unfolded state, both the left shelf and the right shelf are located at horizontal positions, and, when the foldable storage rack is in the folded state, the left shelf and the right shelf are rotated to close to each other.

In the foldable storage rack in accordance with some embodiments of the present invention, the guide grooves are arranged in upper portions of the first side frame and the second side frame, respectively; and when the slide shafts slide to lower ends of the guide grooves, the foldable storage rack is in the unfolded state; and, when the slide shafts slide to upper ends of the guide grooves, the foldable storage rack is in the folded state.

In the foldable storage rack in accordance with some embodiments of the present invention, several shelves are distributed in the vertical direction, and the foldable storage rack further comprises a guide rod; and the guide rod is located in the rear of the foldable storage rack and connected to the shelves.

The foldable storage rack in accordance with some embodiments of the present invention further comprises a first locking device or a second locking device, for locking the connecting arms in the unfolded state; and wherein the first locking device is arranged in the rear of the foldable storage rack and comprises a first limiting rod, a first locking plate and an adjusting member, wherein one end of the first limiting rod is fixed on the guide rod, one end of the adjusting member and one end of the first locking plate are hinged to the connecting arms; in a locked state, the other end of the first locking plate is buckled with the other end of the first limiting rod, and, the adjusting member is configured to adjust the tightness of the buckled connection between the other end of the first locking plate and the other end of the first limiting rod; and the second locking device is arranged in the rear of the foldable storage rack and comprises a second limiting rod and a second locking plate, one end of the second locking plate is hinged to the guide rod, one end of the second limiting rod is fixed on the connecting arms; and, in a locked state, the other end of the second locking plate is buckled with the other end of the second limiting rod.

The foldable storage rack in accordance with some embodiments of the present invention further comprises a roof; and wherein the roof is located at an upper end of the foldable storage rack, one side of the roof is hinged to or detachably buckled with one side of the side frames, and the roof can be turned upside down.

The foldable storage rack in accordance with some embodiments of the present invention, further comprises a support rod and a suspension device; and wherein the roof is connected to one side of the side frames through the suspension device, and one end of the support rod is clamped on the roof and the other end thereof is clamped on one side of the side frames to support the roof.

In the foldable storage rack in accordance with some embodiments of the present invention, the suspension device comprises a groove and a hanging rod; and the groove is arranged on one side of the roof, and one end of the hanging rod is fixed on one side of the side frames and the other end thereof is buckled with the groove.

The foldable storage rack in accordance with some embodiments of the present invention further comprises casters; and wherein several casters are arranged at lower ends of the first side frame and the second side frame, respectively.

The foldable storage rack in accordance with some embodiments of the present invention further comprises a screw rod; and wherein the screw rod is connected to a lower end of the guide rod through threads to support the shelves.

The foldable storage rack in accordance with some embodiments of the present invention further comprises a third locking device for locking the side frames when the foldable storage rack is in the folded state; and wherein the third locking device comprises a third locking plate and a third limiting rod, one end of the third locking plate and one end of the third limiting rod are fixed on the first side frame and the second side frame, respectively; and, in a locked state, the other end of the third locking plate is buckled with the other end of the third limiting rod.

The foldable storage rack according to the embodiments of the present invention has at least the following beneficial effects. When the foldable storage rack is unfolded, a user's storage needs can be met; and, when the foldable storage rack is transported or idle, the side frames, the connecting arms and the shelves of the foldable storage rack are folded in an interlinked manner. The foldable storage rack in a folded state occupies a small space and is convenient for placement and transportation. Additionally, in the unfolding or folding process, it is unnecessary to disassemble or assemble the components, which is advantageous to prevent components from missing.

BRIEF DESCRIPTION OF THE DRAWINGS

The present invention will be further described below by embodiments with reference to the accompanying drawings, wherein.

DETAILED DESCRIPTION OF THE PRESENT INVENTION

Figure 1:
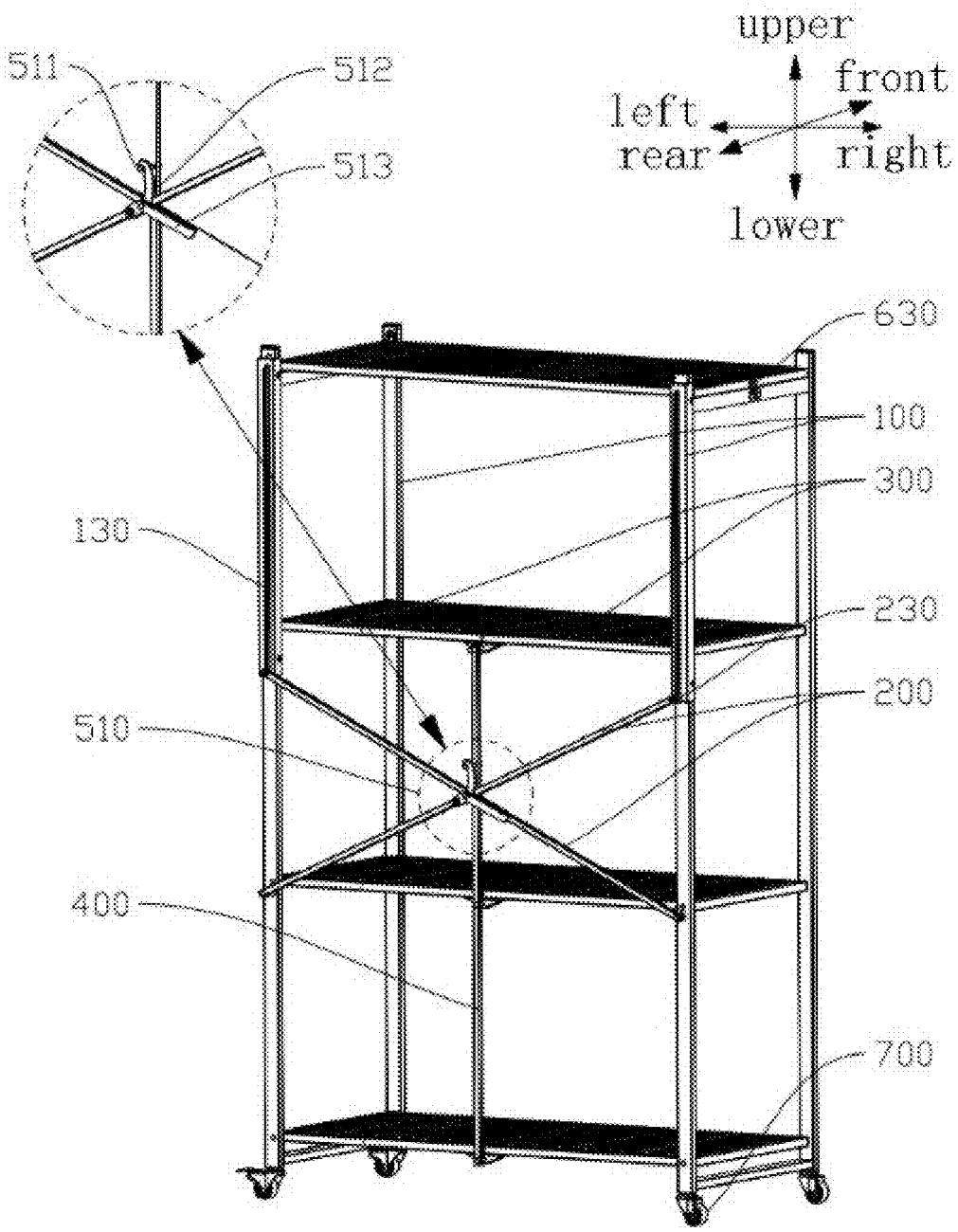
FIG. 1 is a schematic structural diagram of a foldable storage of an embodiment of the present invention.

The embodiments of the present invention will be described below in detail. The examples of these embodiments have been illustrated in the accompanying drawings throughout which same or similar reference numerals refer to same or similar elements or elements having same or similar functions. The embodiments to be described with reference to the accompanying drawings are illustrative, and are merely used for explaining the present invention rather than limiting the present invention.

In the description of this specification, reference terms "an embodiment", "some embodiments", "an example", "a specific example", "some examples" and the like mean that a specific feature, structure, material or characteristic described in conjunction with this embodiment or example is included in at least one embodiment or example of the present invention. In this specification, the schematic expressions of these terms are not necessarily specific to a same embodiment or example. Moreover, the described specific feature, structure, material or characteristic may be combined appropriately in any one or more embodiments or examples. Additionally, different embodiments or examples described in this specification can be conjugated and combined by those skilled in the art.

It will be appreciated that, in the description of the present invention, the orientation or positional relationship indicated by terms "upper", "lower", "front", "rear", "left", "right", "vertical", "horizontal", "top", "bottom", "inside", "outside" or the like is an orientation or positional relationship shown based on the accompanying drawings, merely for describing the present invention and simplifying the description rather than indicating or implying that the specified device or element must have a particular orientation or be constructed and operated in a particular orientation. Therefore, the terms shall not be interpreted as any limitations to the present invention.

In addition, the terms "first", "second" and "third" are merely for illustrative purpose, and shall not be interpreted as indicating or implying the relative importance or implicitly indicating the number of the specified technical features. Therefore, the features defined by the terms "first", "second" and "third" may explicitly or implicitly include one or more features. In the description of the present invention, "a plurality of" means at least two, for example, two, three or the like, unless otherwise explicitly defined.

In the description of the present invention, unless otherwise explicitly defined, the terms "arrange", "mount", "connect" or the like shall be interpreted in a broad sense. The specific meanings of these terms in the present invention can be rationally determined in combination with the specific contents of the technical solutions by those skilled in the art.

In an embodiment of the present invention, a foldable storage rack is provided, including side frames 100, connecting arms 200 and shelves 300. The side frames 100 include a first side frame 110 and a second side frame 120. Guide grooves 130 are formed on rear side faces of the first side frame 110 and the second side frame 120, respectively. The guide grooves 130 are in an elongated shape extending in a vertical direction. The connecting arms 200 are located in the rear of the foldable storage rack, and include a first connecting arm 210 and a second connecting arm 220. One end of the first connecting arm 210 and one end of the second connecting arm 220 are hinged to slide shafts 230, respectively. The first connecting arm 210 is intersected and connected with the second connecting arm 220. The slide shafts 230 are embedded into and slide along the guide grooves 130. When the slide shafts 230 slide to two ends of the guide grooves 130, the foldable storage rack is in an unfolded or folded state. The other end of the first connecting arm 210 is hinged to the second side frame 120, and the other end of the second connecting arm 220 is hinged to the first side frame 110. When the foldable storage rack is in the unfolded state, the first side frame 110 and the second side frame 120 are located on left and right sides of the foldable storage rack, respectively; and, when the foldable storage rack is in the folded state, the first side frame 110 and the second side frame 120 get close to each other. The shelves 300 include a left shelf 310 and a right shelf 320. One end of the left shelf 310 is hinged to one end of the right shelf 320, the other end of the left shelf 310 is hinged to the first side frame 110, and the other end of the right shelf 320 is hinged to the second side frame 120. When the foldable storage rack is in the unfolded state, both the left shelf 310 and the right shelf 320 are located at horizontal positions;

and, when the foldable storage rack is in the folded state, the left shelf 310 and the right shelf 320 are rotated to get close to each other.

It should be understood that, since the shelves 300 is mainly used for placing articles, when the foldable storage rack is in the unfolded state and both the left shelf 310 and the right shelf 320 in the shelves 300 are located at horizontal positions, the shelves 300 can provide bearing surfaces for placing articles.

Figure 2:
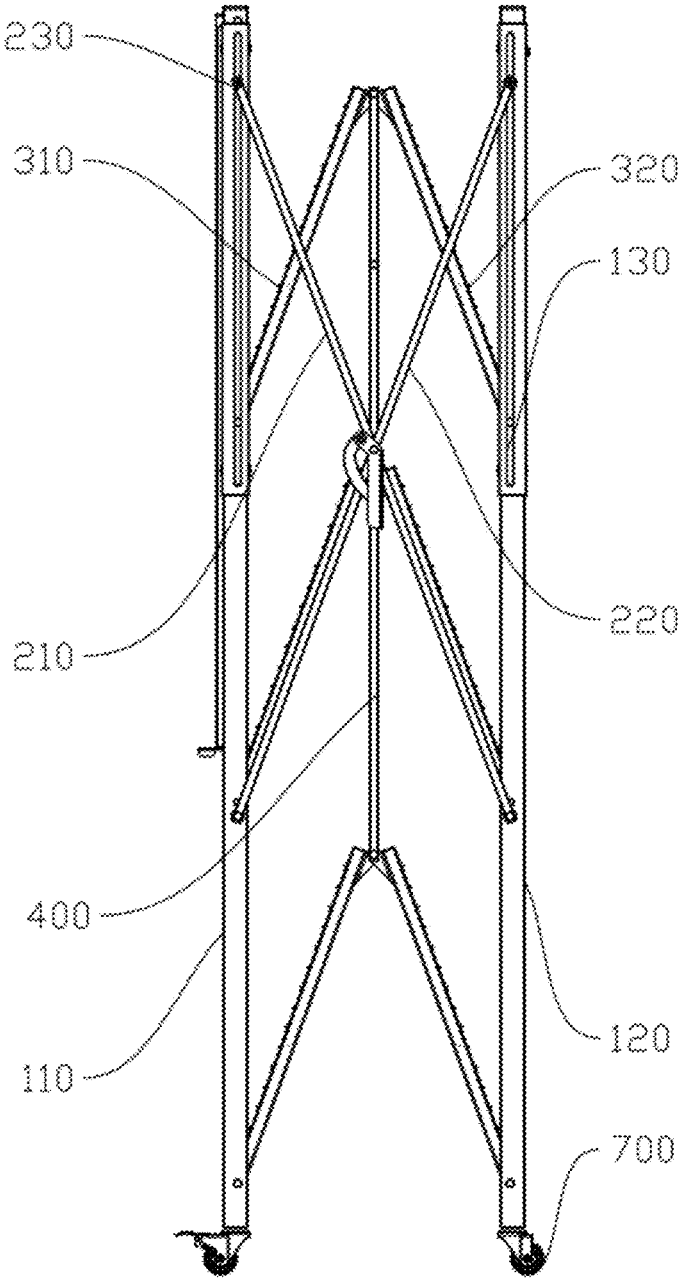
FIG. 2 is a schematic structural diagram of a foldable storage of an embodiment of the present invention.
Figure 9:
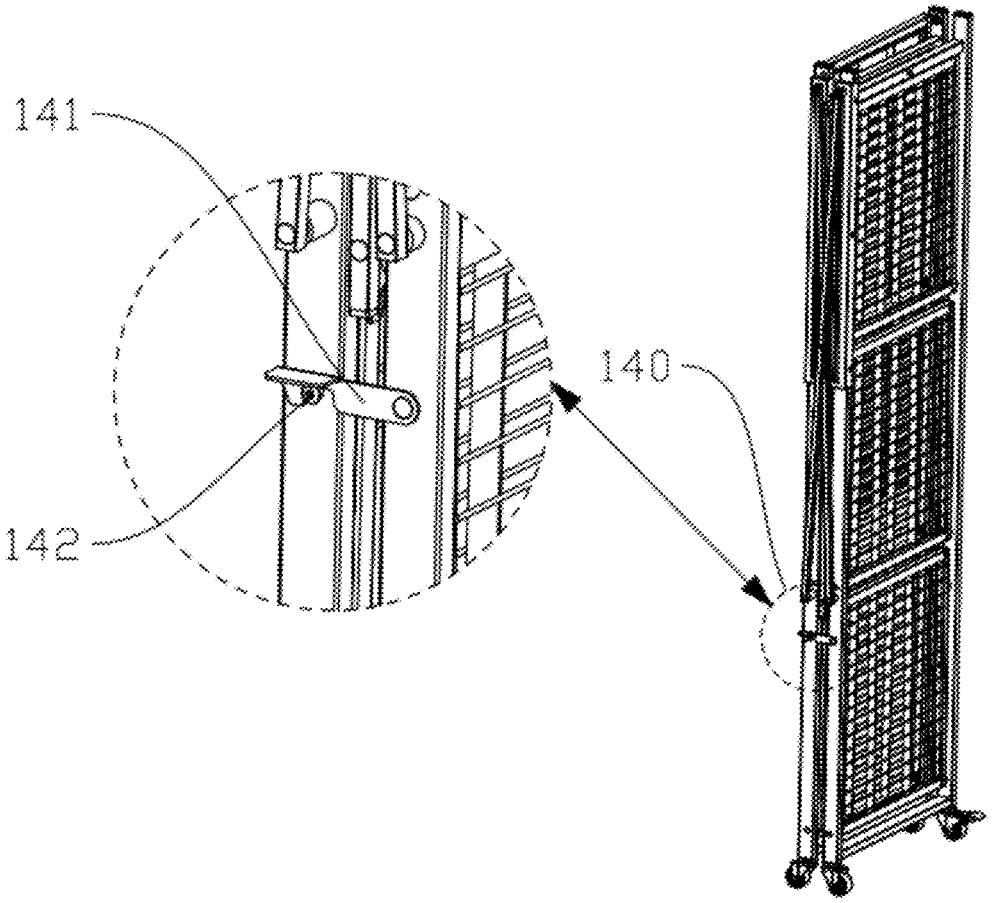
FIG. 9 is a schematic structural diagram of a foldable storage of an embodiment of the present invention.

As shown in FIG. 1, the foldable storage rack is in the unfolded state; as shown in FIG. 9, the foldable storage rack is in the folded state; and, as shown in FIG. 2, the foldable storage rack is in a transition state between the folded state and the unfolded state. It should be understood that, in the above embodiment, during the realization of the transition state between the folded state and the unfolded state, the slide shafts 230, that are respectively hinged to one end of the first connecting arm 210 and one end of the second connecting arm 220, slide in the guide grooves 130 on the side frames 100. Correspondingly, due to the structures of the side frames 100, the connecting arms 200 and the shelves 300 and the connection relationship therebetween, the side frames 100, the connecting arms 200 and the shelves 300 are allowed to move in association with each other, and the switchover between the unfolded state and the folded state of the foldable storage rack is finally realized.

Figure 4:
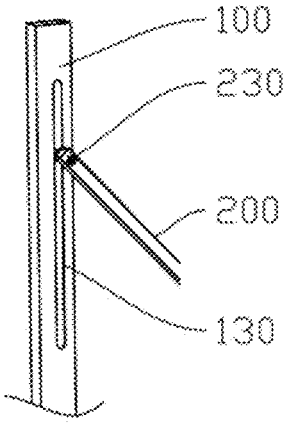
FIG. 4 is a schematic structural diagram of the connection of side frames and connecting arms according to an embodiment of the present invention.

It should be understood that the guide grooves 130 may be integrated with the side frames 100, or may be fixedly mounted on the side frames 100 as components. Specifically, in the case where the guide grooves 130 are integrated with the side frames 100, as shown in FIG. 4, the guide grooves 130 may be elongated grooves extending in the vertical direction formed on the first side frame 110 and the second side frame 120. Additionally, the guide grooves 130 may also be hollow structures extending in the vertical direction arranged on the first side frame 110 and the second side frame 120. The guide grooves 130 are fixedly mounted on the side frames 100 as components, as shown in FIGS. 1 and 2. It should be understood that, as shown in FIGS. 1 and 2, when the guide grooves 130 are fixedly mounted on the side frames 100 as components, it is advantageous to reduce the thickness of the side frames, allowing the foldable storage rack to be more portable.

Figure 5:
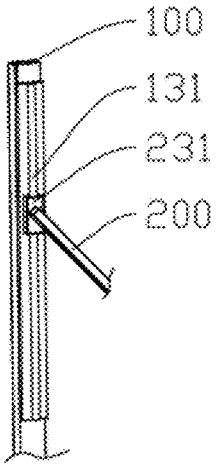
FIG. 5 is a schematic structural diagram associated with an embodiment of the present invention.

It should be understood that, in the embodiment, one end of each connecting arm 200 is slidingly connected to one end of each side frame 100; and during the sliding process of one end of the connecting arm 200 relative to the side frame 100 in the vertical direction, one end of the connecting arm 200 may also be rotated relative to the side frame 100 in a rear plane of the foldable storage rack. Therefore, for the specific structure of the sliding connection of one end of the connecting arm 200 with the side frame 100, those skilled in the art may easily conceive of the structure shown in FIG. 5. As shown in FIG. 5, one end of each of the connecting arms 200 is hinged to moving ends 231 of slide rails, and fixed ends 131 of the slide rails are located on the side frames 100. It should be understood that both ends of the fixed ends 131 of the slide rails in the vertical direction should have limiting devices for limiting the moving ends 231 of the slide rails to slide within a particular range in the vertical direction. However, with this structure, the production cost will be increased to a certain extent. Thus, the connection structure of the connecting arms 200 and the side frames 100 in the embodiment of the first aspect of the present invention is preferable.

Figure 3:
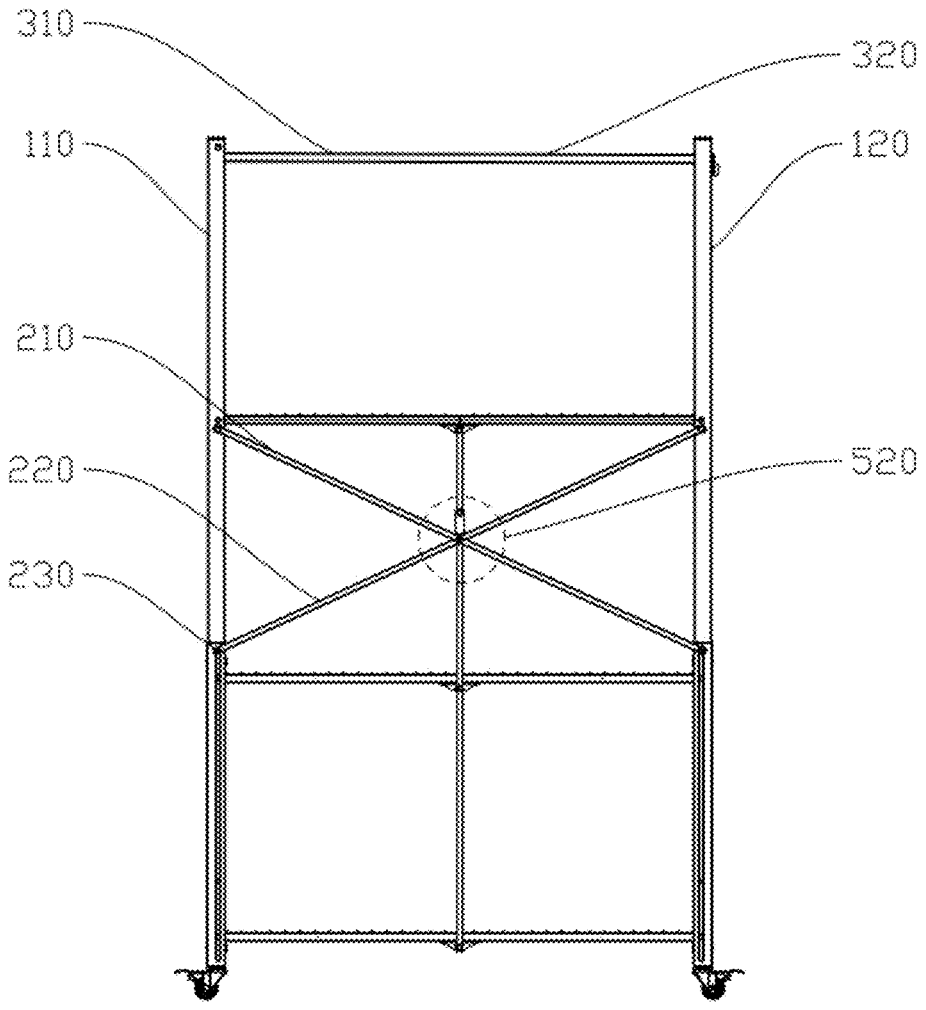
FIG. 3 is a schematic structural diagram of a foldable storage of an embodiment of the present invention.

It should be understood that, the guide grooves 130 may be formed in upper portions of the first side frame 110 and the second side frame 120, and the joint of the first connecting arm 210 with the second side frame 120 and the joint of the second connecting arm 220 with the first side frame 110 are correspondingly located below the guide grooves 130. Additionally, as shown in FIG. 3, the guide grooves 130 may be formed in lower portions of the first side frame 110 and the second side frame 120, and the joint of the first connecting arm 210 with the second side frame 120 and the joint of the second connecting arm 220 with the first side frame 110 are correspondingly located above the guide grooves 130.

Now, how to realize the switchover between the unfolded state and the folded state will be described in detail with respect to the case where the guide grooves 130 are formed in upper portions of the first side frame 110 and the second side frame 120.

In some specific embodiments of the present invention, the guide grooves 130 are formed in upper portions of the first side frame 110 and the second side frame 120, respectively; when the slide shafts 230 slide to lower ends of the guide grooves 130, the foldable storage rack is in the unfolded state; and, when the slide shafts 230 slide to upper ends of the guide grooves 130, the foldable storage rack is in the folded state.

As shown in FIG. 1, the foldable storage rack is in the unfolded state; as shown in FIG. 9, the foldable storage rack is in the folded state; and, as shown in FIG. 2, the foldable storage rack is in a transition state between the folded state and the unfolded state. When the foldable storage rack is in the unfolded state, as shown in FIG. 1, the slide shafts 230 are located at lower ends of the guide grooves 130; the first side frame 110 and the second side frame 120 are located on left and right sides of the foldable storage rack, respectively; and, both the left shelf 310 and the right shelf 320 are located at horizontal positions. When the slide shafts 230 slide upward from the lower ends of the guide grooves 130, as shown in FIG. 2, under the drive of the first connecting arm 210 and the second connecting arm 220, the first side frame 110 and the second side frame 120 are translated toward each other; and, due to the translation of the first side frame 110 and the second side frame 120 toward each other, the left shelf 310 and the right shelf 320 are rotated about the joint of the left shelf 310 with the first side frame 110 and the joint of the right shelf 320 with the second side frame 120, respectively. It should be understood that the hinged connection between the left shelf 310 and the right shelf 320 serves to allow the shelves 300 to be folded due to the translation of the first side frame 110 and the second side frame 120 toward each other. When the slide shafts 230 slide upward from the lower ends of the guide grooves 130 to the upper ends of the guide grooves 130, as shown in FIG. 9, the first side frame 110 and the second side frame 120 are translated to get close to each other, and the left shelf 310 and the second shelf 320 are rotated to get close to each other.

Therefore, when the foldable storage rack is unfolded, a user's storage needs can be met; and, when the foldable storage rack is transported or idle, the side frames 100, the connecting arms 200 and the shelves 300 of the foldable storage rack are folded in an interlinked manner. The foldable storage rack in a folded state occupies a small space and is convenient for placement and transportation. Additionally, in the unfolding or folding process, it is unnecessary to disassemble or assemble components, which is advantageous to prevent components from missing.

In some specific embodiments of the present invention, there are a number of shelves 300 which are distributed in the vertical direction; the foldable storage rack further comprises a guide rod; and, the guide rod 400 is located in the rear of the foldable storage rack and connected to the shelves 300. As shown in FIGS. 1 and 2, there are a number of shelves 300 which are distributed in the vertical direction, so that the foldable storage rack has several layers of storage spaces. Particularly for a foldable storage rack with multiple layers of storage spaces, the guide rod 400 connects a number of shelves 300 together, so that the shelves 300 move consistently, other than independently and irregularly during the folding or unfolding process, enabling the foldable storage rack to be more convenient and durable when in use.

Figure 6:
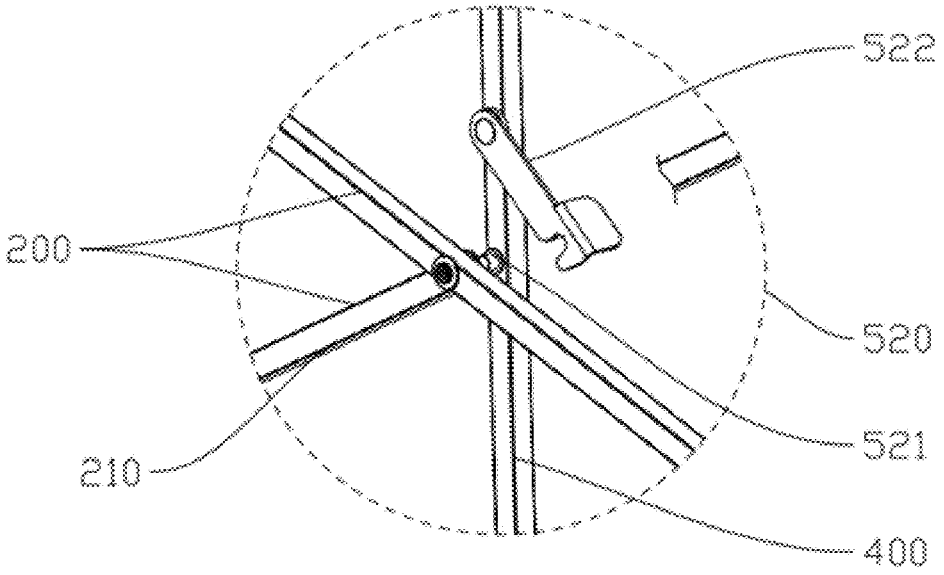
FIG. 6 is a schematic structural diagram of a locking device according to an embodiment of the present invention.

In some specific embodiments of the present invention, the foldable storage rack further comprises a first locking device 510 or a second locking device 520 used for locking the connecting arms 200 when the foldable storage rack is in the unfolded state. As shown in FIG. 1, the first locking device 510 is located in the rear of the foldable storage rack, and comprises a first limiting rod 511, a first locking plate 512 and an adjusting member 513. One end of the first limiting rod 511 is fixed on the guide rod 400. One end of the adjusting member 513 and one end of the first locking plate 512 are hinged to the connecting arms 200. In a locked state, the other end of the first locking plate 512 is buckled with the other end of the first limiting rod 511. The adjusting member 513 is used for adjusting the tightness of the buckled connection between the other end of the first locking plate 512 and the other end of the first limiting rod 511. As shown in FIG. 6, the second locking device 520 is located in the rear of the foldable storage rack, and comprises a second limiting rod 521 and a second locking plate 522. One end of the second locking plate 522 is hinged to the guide rod 400, and one end of the second limiting rod 521 is fixed on the connecting arms 200. In a locked state, the other end of the second locking plate 522 is buckled with the other end of the second limiting rod 521.

It should be understood that, both the first locking device 510 shown in FIG. 1 and the second locking device 520 shown in FIG. 6 are used for locking the connecting arms 200 when the foldable storage rack is in the unfolded state, so that the whole foldable storage rack can be kept in the unfolded state. Specifically, the slide shafts 230 are prevented from sliding upward from the lower ends of the guide grooves 130 due to the placement of articles, artificial collision or the like. It should be understood that, when the slide shafts 230 are located at the lower ends of the guide grooves 130, the lower ends of the guide grooves 130 can prevent the slide shafts 230 from continuously sliding downward. However, in this case, the guide grooves 130 cannot prevent the slide shafts 230 from sliding upward from the lower ends. The first locking device 510 and the second locking device 520 lock the connecting arms 200 by different specific structures, so as to prevent the slide shafts 230 from sliding upward from the lower ends. Specifically, the number of components of the second locking device 520 is less than that of components of the first locking device 510, and the second locking device 520 is more advantageous for the compactness of arrangement.

Figure 7:
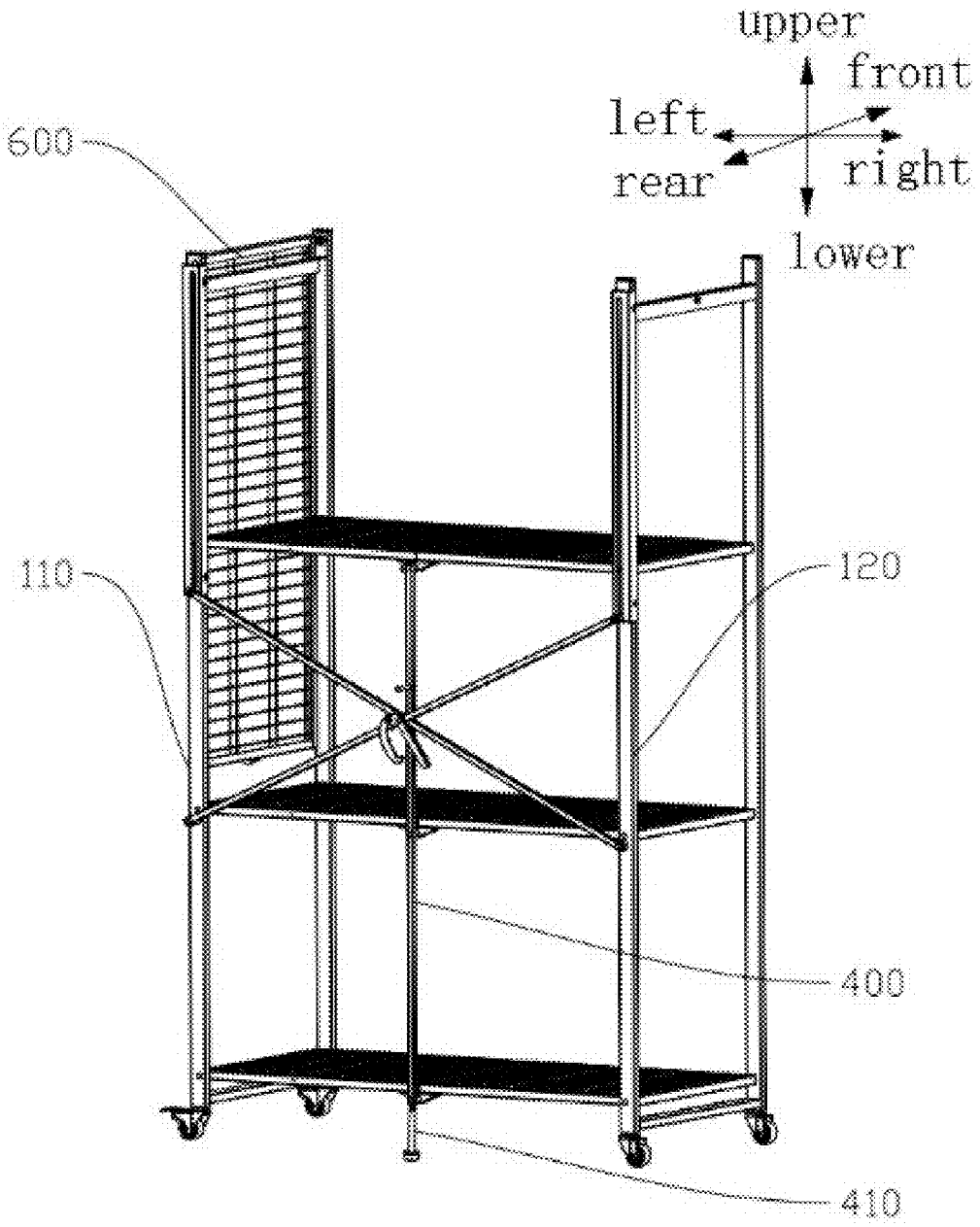
FIG. 7 is a schematic structural diagram of a foldable storage of an embodiment of the present invention.

In some specific embodiments of the present invention, as shown in FIGS. 1 and 7, the foldable storage rack further comprises a roof 600. The roof 600 is located at an upper end of the foldable storage rack. One side of the roof 600 is hinged to or detachably buckled with one side of the side frames 100, and the roof 600 can be turned upside down. The structure of the roof 600 is advantageous for a user to select whether to use the roof 600 as required. When not used, as shown in FIG. 7, the roof 600 may be buckled with one side of the side frames 100, so that the roof 600 can be prevented from missing due to random placement. It should be understood that one side of the roof 600 may also be hinged to one side of the side frames 100. If not used, the roof 600 may be turned to one side of the side frames 100. In addition, one side of the roof 600 may also be detachably buckled with one side of the side frames 100 through a buckle mechanism 630 shown in FIG. 1. When the roof 600 is used, the buckle mechanism 630 can be used for locking the roof 600, so that it is advantageous to prevent the shelves 300 from being folded due to an external force. When not used, the roof 600 may be detachably bucked on one side of the side frames 100 through the buckle mechanism 630 and the side frames 100.

Figure 8:
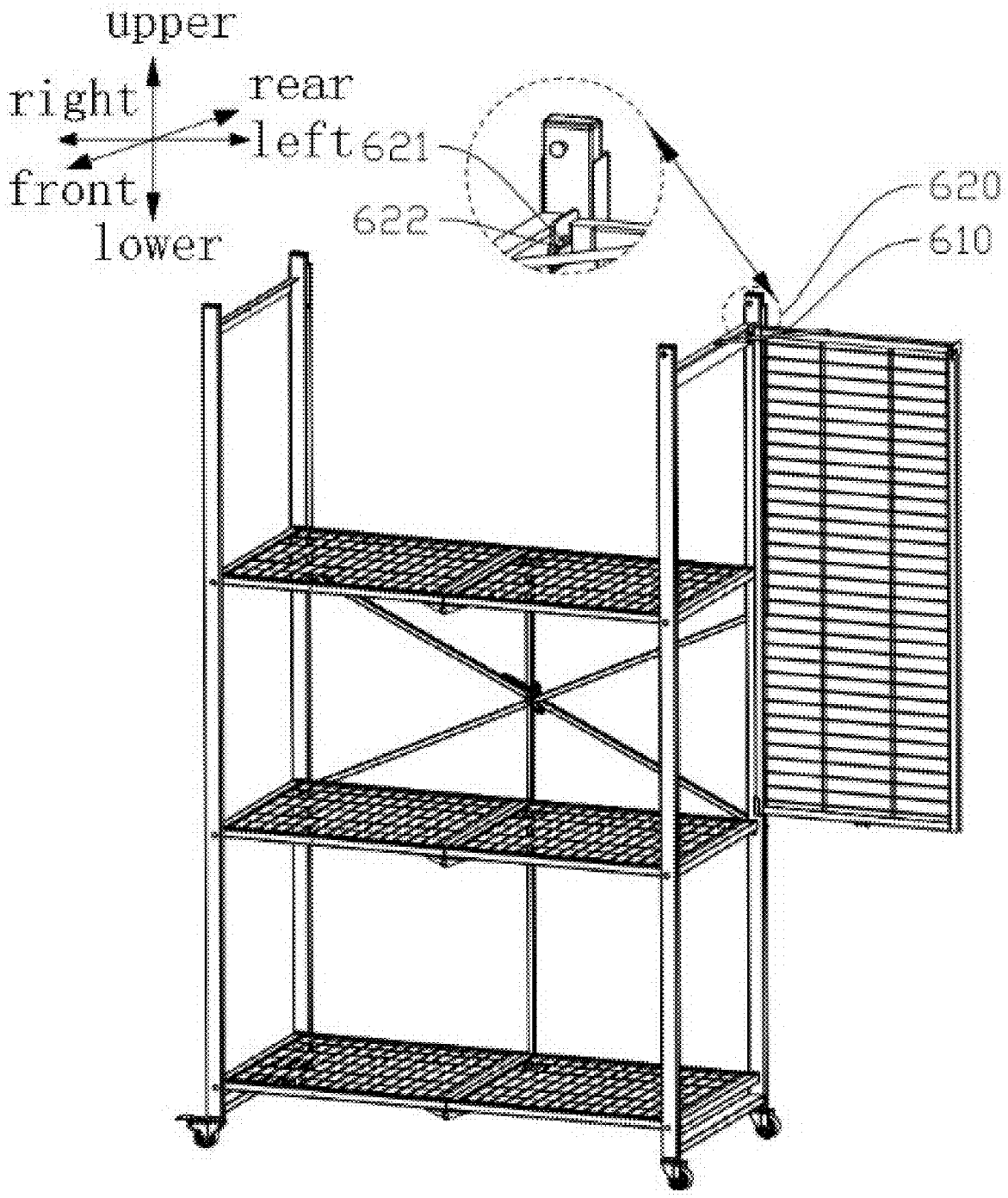
FIG. 8 is a schematic structural diagram of a foldable storage of an embodiment of the present invention.

In some specific embodiments of the present invention, as shown in FIG. 8, the foldable storage rack further comprises a support rod 610 and a suspension device 620. The roof 600 is connected to one side of the side frames 100 through the suspension device 620. One end of the support rod 610 is clamped on the roof 600, and the other end thereof is clamped on one side of the side frames 100 to support the roof 600. This is another way of arranging the roof 600. In order to provide more choices for the user, the user can select whether to use the roof 600 as required. If not used, as shown in FIG. 8, the roof 600 may be connected to the side frames 100 through the support rod 610 and the suspension device 620, so that the roof 600 can be prevented from missing due to random placement.

In some specific embodiments of the present invention, as shown in FIGS. 1 and 2, the foldable storage rack further comprises casters 700. There are a number of casters 700 which are located at lower ends of the first side frame 110 and the second side frame 120, respectively, to facilitate the movement of the foldable storage rack.

In some specific embodiments of the present invention, as shown in FIG. 7, the foldable storage rack further comprises a screw rod 410. The screw rod 410 is connected to a lower end of the guide rod 400 through threads to support the shelves 300. The height of the bottom of the foldable storage rack is different depending on whether the casters 700 are mounted or not. By rotating the screw rod 410, the shelves 300 can still be supported in the case of different heights.

In some specific embodiments of the present invention, as shown in FIG. 9, the foldable storage rack further comprises a third locking device 140 used for locking the side frames 100 when the foldable storage rack is in the folded state. The third locking device 140 comprises a third locking plate 141 and a third limiting rod 142. One end of the third locking plate 141 and one end of the third limiting rod 142 are fixed on the first side frame 110 and the second side frame 120, respectively. In a locked state, the other end of the third locking plate 141 is buckled with the other end of the third limiting rod 142. It should be understood that the specific mounting position of the third locking device 140 may be on upper, lower, front or rear side faces of the first side frame 110 and the second side face 120. The arrangement of the third locking device 140 is advantageous to ensure that the foldable storage rack is in the folded state during the transportation or placement.

Although the embodiments of the present invention have been shown and described above, it should be understood that the embodiments are exemplary and shall not be regarded as limiting the present invention, and alterations, modifications, replacements and variations may be made to the embodiments by a person of ordinary skill in the art without departing from the scope of the present invention.

The invention claimed is:

1. A foldable storage rack, comprising:

side frames, comprising a first side frame, a second side frame, and guide grooves in an elongated shape extending in a vertical direction and respectively arranged on rear side faces of the first side frame and the second side frame;

connecting arms, arranged in the rear of the foldable storage rack, and comprising a first connecting arm, a second connecting arm, and slide shafts, wherein: one end of each of the first connecting arm and the second connecting arm is hinged to one of the slide shafts, the first connecting arm is intersected and connected with the second connecting arm, the slide shafts are embedded into and slide along the guide grooves, such that, when the slide shafts slide to ends of the guide grooves, the foldable storage rack is in an unfolded or folded state; the other end of the first connecting arm is hinged to the second side frame, and the other end of the second connecting arm is hinged to the first side frame, such that, when the foldable storage rack is in the unfolded state, the first side frame and the second side frame are respectively located on left and right sides of the foldable storage rack, and, when the foldable storage rack is in the folded state, the first side frame and the second side frame are close to each other;

shelves, comprising a left shelf and a right shelf, wherein, one end of the left shelf is hinged to one end of the right shelf, the other end of the left shelf is hinged to the first side frame, and the other end of the right shelf is hinged to the second side frame, such that, when the foldable storage rack is in the unfolded state, both the left shelf and the right shelf are located at horizontal positions, and, when the foldable storage rack is in the folded state, the left shelf and the right shelf are rotated to close to each other;

a guide rod and;

a first locking device or a second locking device, for locking the connecting arms in the unfolded state; wherein, the guide grooves are arranged in upper portions of the first side frame and the second side frame, respectively;

when the slide shafts slide to lower ends of the guide grooves, the foldable storage rack is in the unfolded state; and, when the slide shafts slide to upper ends of the guide grooves, the foldable storage rack is in the folded state;

several shelves are distributed in the vertical direction, the guide rod is located in the rear of the foldable storage rack and connected to the shelves;

the first locking device is arranged in the rear of the foldable storage rack and comprises a first limiting rod, a first locking plate and an adjusting member, wherein one end of the first limiting rod is fixed on the guide rod, one end of the adjusting member and one end of the first locking plate are hinged to the connecting arms; in a locked state, the other end of the first locking plate is buckled with the other end of the first limiting rod, and, the adjusting member is configured to adjust the tightness of the buckled connection between the other end of the first locking plate and the other end of the first limiting rod; and the second locking device is arranged in the rear of the foldable storage rack and comprises a second limiting rod and a second locking plate, one end of the second locking plate is hinged to the guide rod, one end of the second limiting rod is fixed on the connecting arms; and, in a locked state, the other end of the second locking plate is buckled with the other end of the second limiting rod.

2. The foldable storage rack according to claim 1, further comprising a roof; and wherein, the roof is located at an upper end of the foldable storage rack, one side of the roof is hinged to or detachably buckled with one side of the side frames, and the roof can be turned upside down.

3. The foldable storage rack according to claim 2, further comprising a support rod and a suspension device; and wherein, the roof is connected to one side of the side frames through the suspension device, and one end of the support rod is clamped on the roof and the other end thereof is clamped on one side of the side frames to support the roof.

4. The foldable storage rack according to claim 3, wherein, the suspension device comprises a groove and a hanging rod; and the groove is arranged on one side of the roof, and one end of the hanging rod is fixed on one side of the side frames and the other end thereof is buckled with the groove.

5. The foldable storage rack according to claim 1, further comprising casters; and wherein, several casters are arranged at lower ends of the first side frame and the second side frame, respectively.

6. The foldable storage rack according to claim 1, further comprising a screw rod; and wherein, the screw rod is connected to a lower end of the guide rod through threads to support the shelves.

7. The foldable storage rack according to claim 1, further comprising a third locking device for locking the side frames when the foldable storage rack is in the folded state; and wherein, the third locking device comprises a third locking plate and a third limiting rod, one end of the third locking plate and one end of the third limiting rod are fixed on the first side frame and the second side frame, respectively; and, in a locked state, the other end of the third locking plate is buckled with the other end of the third limiting rod.

* * * * *